US010202876B2

(12) United States Patent
Suzuki et al.

(10) Patent No.: US 10,202,876 B2
(45) Date of Patent: Feb. 12, 2019

(54) LASH ADJUSTER

(71) Applicant: OTICS CORPORATION, Nishio-shi, Aichi (JP)

(72) Inventors: Hiroyuki Suzuki, Nishio (JP); Kyosuke Sugiura, Nishio (JP); Haruyasu Tanaka, Nishio (JP)

(73) Assignee: OTICS CORPORATION, Nishio-Shi, Aichi (JP)

( * ) Notice: Subject to any disclaimer, the term of this patent is extended or adjusted under 35 U.S.C. 154(b) by 125 days.

(21) Appl. No.: 15/347,183

(22) Filed: Nov. 9, 2016

(65) Prior Publication Data

US 2017/0145870 A1 May 25, 2017

(30) Foreign Application Priority Data

Nov. 20, 2015 (JP) ..... 2015-227354

(51) Int. Cl.

| | |
|---|---|
| ***F01L 1/24*** | (2006.01) |
| ***F01M 9/10*** | (2006.01) |
| *F01L 1/46* | (2006.01) |
| *F01L 1/18* | (2006.01) |

(52) U.S. Cl.

CPC ..... *F01L 1/2416* (2013.01); *F01L 1/2405* (2013.01); *F01M 9/10* (2013.01); *F01L 1/185* (2013.01); *F01L 1/46* (2013.01); *F01L 2105/00* (2013.01)

(58) Field of Classification Search

CPC ... F01L 1/14; F01L 1/24; F01L 1/2405; F01L 1/2411; F01L 1/2422; F01L 1/46

USPC ..... 123/90.43, 90.46, 90.55

See application file for complete search history.

(56) References Cited

U.S. PATENT DOCUMENTS

| | | | | |
|---|---|---|---|---|
| 2009/0107428 | A1* | 4/2009 | Magnan | F01L 1/181 123/90.12 |
| 2011/0000452 | A1 | 1/2011 | Fujii et al. | |
| 2014/0224202 | A1* | 8/2014 | Suzuki | F01L 1/2405 123/90.46 |
| 2017/0044937 | A1* | 2/2017 | Ozawa | F01L 1/245 |

FOREIGN PATENT DOCUMENTS

| | | | | |
|---|---|---|---|---|
| JP | 2009-191690 | A | 8/2009 | |
| WO | WO 2016038753 | A1 * | 3/2016 | F01L 1/245 |

* cited by examiner

*Primary Examiner* — Jorge Leon, Jr.

(74) *Attorney, Agent, or Firm* — Smith, Gambrell & Russell, LLP

(57) ABSTRACT

A lash adjuster includes a bottomed cylindrical body and a cylindrical plunger reciprocably inserted into the body and having a bottom wall and a peripheral wall. The plunger has a low-pressure chamber. The peripheral wall of the plunger includes an annular band portion abutting against an upper part of a peripheral wall of the body. The peripheral wall of the plunger has a plurality of plunger oil holes located below the band portion. The plunger oil holes include respective lower ends defining a level of the oil stored in the low-pressure chamber. The plurality of plunger oil holes are located at a common height position of the peripheral wall of the plunger coming close to the band portion.

9 Claims, 5 Drawing Sheets

LASH ADJUSTER

CROSS-REFERENCE TO RELATED APPLICATIONS

This application is based upon and claims the benefit of priority from the prior Japanese Patent Application No. 2015-227354 filed on Nov. 20, 2015, the entire contents of which are incorporated herein by reference.

BACKGROUND

1. Technical Field

The present invention relates to a hydraulic lash adjuster.

2. Related Art

Japanese Patent Application Publication No. JP-A-2009-191690 discloses a lash adjuster including a bottomed cylindrical body and a bottomed cylindrical plunger which is inserted into the body so as to be reciprocable in an up-down direction. The plunger has an upper end which protrudes out of the body and which is provided with a substantially semispherical support supporting a rocker arm.

A low-pressure chamber is defined inside the plunger, and a high-pressure chamber is located at a lower interior of the body and defined by a bottom wall of the plunger. The bottom wall of the plunger has a valve port extending therethrough. When the valve port is opened, an operating oil (oil) stored in the low-pressure chamber flows through the valve port into the high-pressure chamber. The plunger changes an amount of protrusion out of the body according to a change in an amount of oil filling the high-pressure chamber, so that the rocker arm can be supported by the lash adjuster at a proper heightwise position.

The plunger has a peripheral wall on which an annular band portion is provided so as to extend over an entire circumference of the peripheral wall. The band portion abuts against an upper part of a peripheral wall of the body substantially in a liquid-tight manner. The peripheral wall of the plunger has one inner communication hole (a plunger oil hole) which extends therethrough and is located below the band portion. The band portion prevents oil from flowing out through a gap between both peripheral walls of the plunger and the body and further prevents foreign matter from externally invading the gap. Furthermore, a lower end of the inner communication hole defines a level of the oil stored in the low-pressure chamber.

The lash adjusters have recently had a tendency to be reduced in size with downsizing of engines. Under these circumstances, settings rendering an increase in an inner volume of the low-pressure chamber difficult are sometimes required of the lash adjusters. In this case, the height position of the inner communication hole may be raised if an amount of oil equal to or larger than a current amount is stored in the low-pressure chamber. However, since the band portion is located above the inner communication hole, an amount of raise of the inner communication hole has a definite limitation with a result that a necessary amount of oil cannot sometimes be stored in the low-pressure chamber. In view of the circumstances, it is considered that, for example, an oil level may be raised by reducing a diameter of the inner communication hole so that a lower end of the inner communication hole is located higher. However, when the diameter of the inner communication hole becomes excessively small, a flow rate of oil passing through the inner communication hole is reduced with a result that a sufficient amount of oil cannot sometimes be supplied into the low-pressure chamber.

SUMMARY

Therefore, an object of the invention is to provide a lash adjuster which can ensure a necessary amount of oil in the low-pressure chamber even when the size of the lash adjuster is reduced.

The invention provides a lash adjuster including a bottomed cylindrical body and a bottomed cylindrical plunger inserted into the body so as to be reciprocable in an up-down direction and having a bottom wall and a peripheral wall. The plunger has an interior in which a low-pressure chamber is defined. The bottom wall of the plunger defines a high-pressure chamber in conjunction with a lower inner part of the body. The bottom wall of the plunger has a valve hole which is formed therethrough and through which an operating oil stored in the low-pressure chamber is allowed to flow into the high-pressure chamber when the valve hole is opened. In the above-described lash adjuster, the peripheral wall of the plunger is provided with an annular band portion abutting against an upper part of a peripheral wall of the body. The peripheral wall of the plunger has a plurality of plunger oil holes formed therethrough so as to be located below the band portion. The plunger oil holes include respective lower ends defining a level of the operating oil stored in the low-pressure chamber. The plurality of plunger oil holes are located at a common height position of the peripheral wall of the plunger in the up-down direction. The common height position comes close to the band portion.

The plurality of plunger oil holes are located at a common height position of the peripheral wall of the plunger in the up-down direction and the common height position comes close to the band portion. Accordingly, the plunger oil holes are located as high as possible. Furthermore, since a flow passage of the oil is shared by the plunger oil holes, the diameter of each plunger oil hole can be rendered smaller. As a result of diameter reduction in each plunger oil hole, the oil level defined at the lower ends of the plunger oil holes can be raised. Consequently, a necessary amount of oil can be ensured in the low-pressure chamber even when the size of the lash adjuster is reduced.

DETAILED DESCRIPTION

First Embodiment

Figure 1:
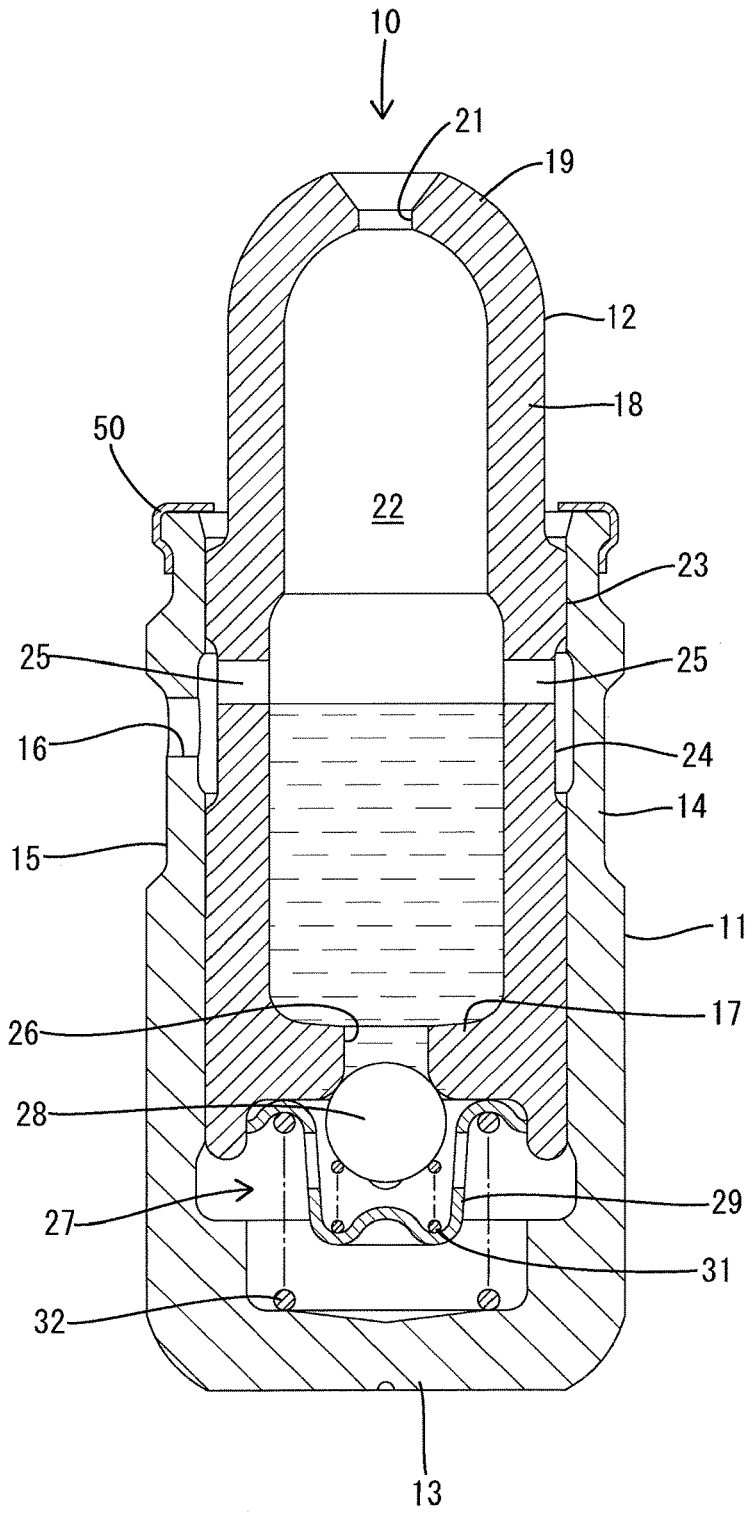
FIG. 1 is a cross sectional view of the lash adjuster of a first embodiment.

A first embodiment will be described with reference to FIGS. 1 and 2. A hydraulic lash adjuster 10 of the first embodiment is mounted on a valve gear of an internal combustion engine and constructed to be smaller in size as compared with conventional lash adjusters.

Figure 2:
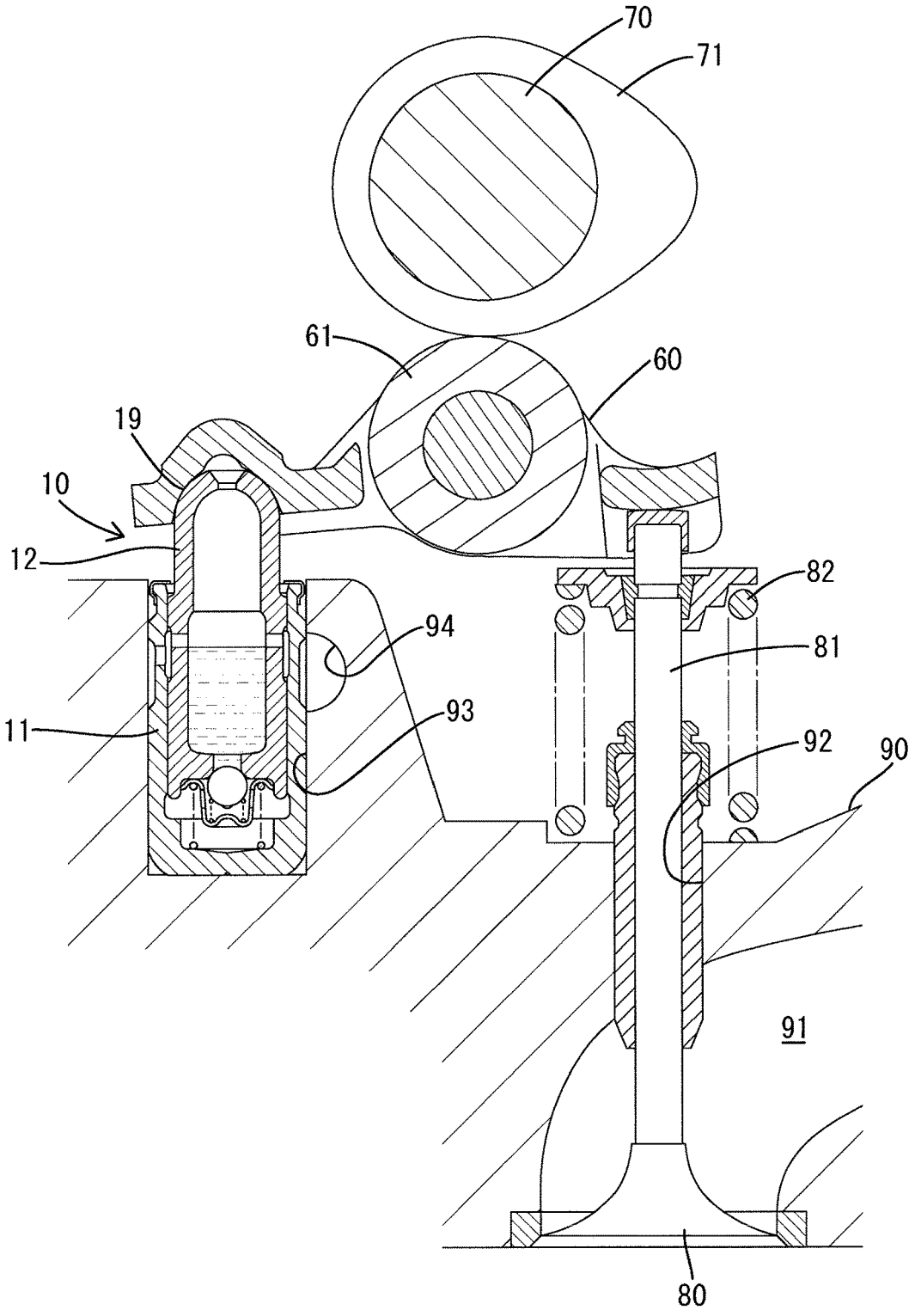
FIG. 2 is a cross sectional view of a valve gear in which the lash adjuster is incorporated.

Referring first to FIG. 2, the valve gear includes a cam 71 mounted on a camshaft 70 rotated in synchronization with the engine, a valve stem 81 mounted on a valve body 80, a rocker arm 60 which is swung in response to rotation of the cam 71 thereby to press the valve stem 81 and the lash adjuster 10 swingably supporting an end of the rocker arm 60.

The valve stem 81 is inserted through a through hole 92 communicating with a suction or exhaust port 91 of a cylinder head 90 and urged by a coil spring 82 in a direction such that the valve body 80 is closed. Upon rotation of the cam 71, the rocker arm 60 is swung to reciprocate the valve stem 81 in the through hole 92, whereby the suction or exhaust port 91 is opened and closed by the valve body 80.

The rocker arm 60 is of a swing arm type and has two ends one of which is supported by the lash adjuster 10 and the other of which is caused to abut against the valve stem 81. The cam 71 is disposed to be rotatably in contact with the roller 61 disposed between the ends of the rocker arm 60.

The lash adjuster 10 is inserted into a mounting hole 93 opened in an upper surface of the cylinder head 90 with an axis line thereof being directed in an up-down direction. The mounting hole 93 has an inner surface with which an oil supply path 94 of the cylinder head 90 communicates. As illustrated in FIG. 1, the lash adjuster 10 includes a bottomed cylindrical body 11 and a bottomed cylindrical plunger 12 which is housed in the body 11 so as to be reciprocable (reciprocally slidable) in the up-down direction.

The body 11 comprises a disk-shaped bottom wall 13 and a peripheral wall 14 rising from an outer periphery of the bottom wall 13. The body 11 has a body circumferential groove 15 extending over an entire circumference of an outer periphery thereof. The body 11 further has one body oil hole 16 extending radially (in a direction of wall thickness of the peripheral wall 14 of the body 11) through the peripheral wall 14 thereof from an inner surface of the groove 15 to an inner periphery of the peripheral wall 14. The peripheral wall 14 has an upper end on which is mounted a retainer 50 preventing the plunger 12 from coming off upwardly.

The plunger 12 comprises a disk-shaped bottom wall 17 slightly smaller than the bottom wall 13 of the body 11 and a peripheral wall 18 rising from an outer circumference of the bottom wall 17 and having an upper end narrowed into a substantially semispherical shape. The peripheral wall 18 of the plunger 12 has an upper end serving as a support 19. The rocker arm 60 has an end which is swingably supported by the semispherical outer periphery of the support 19 (see FIG. 2). The support 19 has an upper end through which a top hole 21 extends in the up-down direction. A low-pressure chamber 22 is defined by the bottom wall 17 and the peripheral wall 18 in an interior of the plunger 12.

The peripheral wall 18 of the plunger 12 is provided with an annular band portion 23. The band portion 23 protrudes outward in a thickened state over an entire circumference. The band portion 23 has an outer periphery which is abuttable against (slidingly contactable with) an inner periphery of the upper part of the peripheral wall 14 of the body 11 along the up-down direction substantially in a liquid-tight manner. A plunger circumferential groove 24 is formed on an outer periphery of the peripheral wall 18 of the plunger 12 over an entire circumference.

The peripheral wall 18 of the plunger 12 is formed with two plunger oil holes 25 extending in a radial direction (in a direction of wall thickness of the peripheral wall 18 of the plunger 12) from an inner surface of the plunger circumferential groove 24 to an inner periphery of the peripheral wall 18. The plunger oil holes 25 have respective perfect circular cross sections and are disposed at a common height position in the up-down direction on the peripheral wall 18 of the plunger 12 so as to be open at an upper part of the plunger circumferential groove 24, which upper part is located close to the band portion 23. The plunger oil holes 25 are located above the body oil hole 16 and have respective hole diameters smaller than a hole diameter of the body oil hole 16.

The plunger oil holes 25 are placed in both radial ends of the peripheral wall 18 so as to be coaxially opposed to each other, respectively. Oil supplied through the oil supply path 94 of the cylinder head 90 flows through the body circumferential groove 15, the body oil hole 16, the plunger circumferential groove 24 and the plunger oil holes 25 to be stored in the low-pressure chamber 22. In this case, even if the body 11 is rotated in the mounting hole 93 of the cylinder head 90, the oil flows through the body circumferential groove 15 into the body oil hole 16, and even if the plunger 12 is rotated in the body 11, the oil flows through the body oil hole 16 into the plunger oil holes 25.

The bottom wall 17 of the plunger 12 has a circular valve hole 26 formed in a radial middle of the bottom wall 17 so as to extend therethrough in the up-down direction. A high-pressure chamber 27 is defined between a lower part of the body 11 and the bottom wall 17 of the plunger 12. The high-pressure chamber 27 is provided with a spherical valving element 28 which is movable in the up-down direction thereby to open and close the valve hole 26, a cage 29 retaining the valving element 28, a first spring comprising a compression coil spring and housed in the cage 29 to urge the valving element 28 toward the valve hole 26 and a second spring 32 comprising a compression coil spring and interposed between an outer peripheral edge of the cage 29 and the bottom wall 13 of the body 11 to urge the plunger 12 upward. The valving element 28 is reciprocable. More specifically, the valving element 28 is normally urged by the first spring 31 thereby to close the valve hole 26 and is lowered against the urging force of the first spring 31 in response to variations in the hydraulic pressure thereby to open the valve hole 26. When the valve hole 26 is opened, the oil in the low-pressure chamber 22 flows through the valve hole 26 into the high-pressure chamber 27.

When the rocker arm 60 is pressed via the roller 61 from above upon rotation of the cam 71, the plunger 12 is pressed by one end of the rocker arm 60 thereby to be moved downward relative to the body 11, so that the oil in the high-pressure chamber 27 is compressed. With increase in the pressure in the high-pressure chamber 27, the oil in the high-pressure chamber 27 flows to the plunger circumferential groove 24 side through a gap between the peripheral wall 14 of the plunger 12 and the peripheral wall 18 of the body 11. This shortens the entire length of the lash adjuster by an amount of oil caused to flow out of the high-pressure chamber 27. Furthermore, the pressure increase in the high-pressure chamber 27 rigidifies the body 11 and the plunger 12, with the result that a support position of the lash adjuster 10 relative to the rocker arm 60 is specified.

On the other hand, when the pressing force the cam 71 applies to the rocker arm 60 is reduced with rotation of the cam 71, the plunger 12 is moved upward both by the pressure of the high-pressure chamber 27 and by the urging force of the second spring 32, so that the upper end of the plunger 12 largely protrudes from the body 11. The pressure in the high-pressure chamber 27 is then reduced with the result that pressure difference is generated between the low-pressure chamber 22 and the high-pressure chamber 27. This causes the valving element 28 to depart from the valve hole 26 thereby to open the vale hole 26, so that the oil flows from the low-pressure chamber 22 into the high-pressure chamber 27 with the result of an increase in the length of the lash adjuster 10. Thus, the rocker arm 60 is supported at a proper position by the lash adjuster 10 according to rotation of the cam 71, whereby valve clearances of the cam 71 and the rocker arm 60 are adjusted so as to be substantially zeroed.

Oil is replenished through the oil supply path 94 of the cylinder head 90 and the plunger oil holes 25 into the low-pressure chamber 22 of the plunger 12, so that the oil stored in the low-pressure chamber 22 reaches positions of the lower ends of the plunger oil holes 25. The oil passes through the two plunger oil holes 25 formed through the peripheral wall 18 of the plunger 12 when flowing into the low-pressure chamber 22. Accordingly, a necessary amount of oil can be stored in the low-pressure chamber 22 even if the diameters of the plunger oil holes 25 are reduced. As a result, each plunger oil hole 25 in the embodiment is set such that the diameter thereof is reduced 20% or more as compared with the conventional plunger oil hole formed through the peripheral wall of the plunger. With reduction in the diameter of each plunger oil hole 25, the lower end position of each plunger oil hole 25 is located above the lower end position of the conventional plunger oil hole, with the result that the level of oil stored in the low-pressure chamber 22 is raised.

In the foregoing embodiment, the plunger oil holes 25 are disposed directly below the annular band portion 23 and at the common height position in the up-down direction thereby to be located as high as possible. As a result, a necessary amount of oil can be stored in the low-pressure chamber 22 even if the lash adjuster 10 has a small size.

Furthermore, since the plunger oil holes 25 are disposed at the common height position of the peripheral wall 18 of the plunger 12 in the up-down direction as described above, the peripheral wall 18 can be punched out by punches or drilling tools (neither shown) and the like installed at a common height position during the manufacture of the plunger 12, with the result that an increase in the manufacturing costs can be suppressed. In this case, the openings may be formed by two punches corresponding to the respective plunger oil holes 25 or the peripheral wall 18 may be rotated about the axis in order to be bored by a single punch.

Furthermore, two plunger oil holes 25 having respective perfect circular cross sections are formed in the peripheral wall 18 of the plunger 12, and the plunger oil holes 25 are located at respective radial ends of the peripheral wall 18 spaced from each other. This can prevent the reduction of the rigidity of the peripheral wall 18.

Second Embodiment

Figure 3:
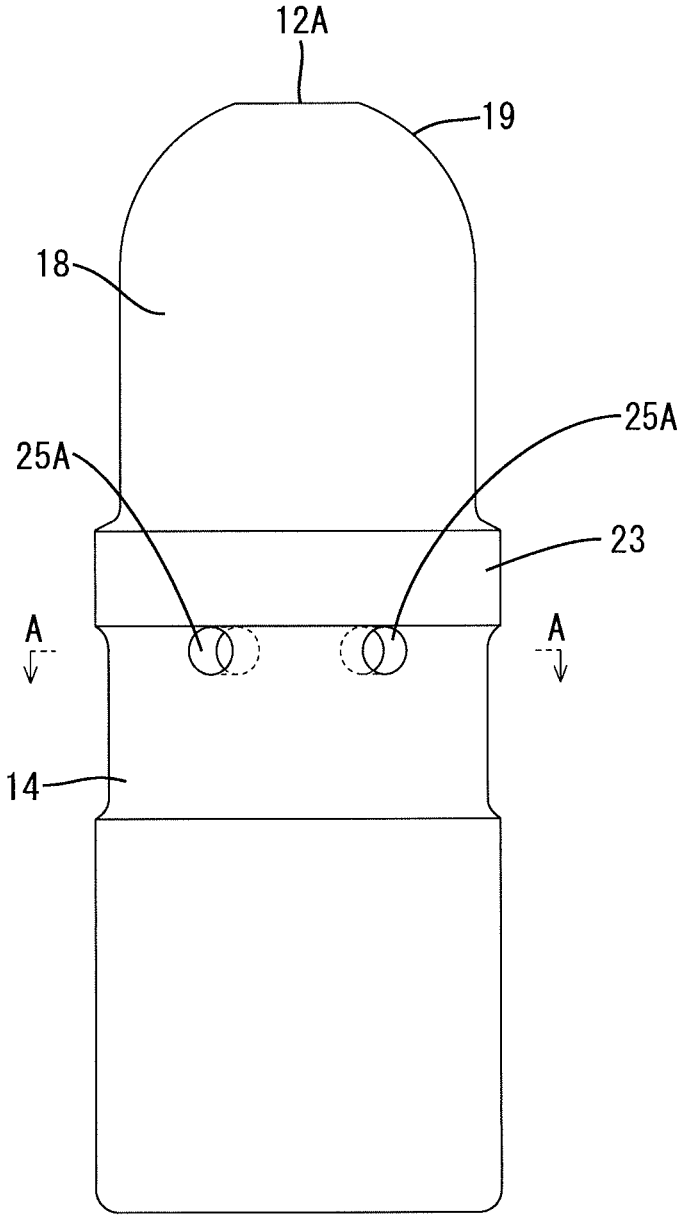
FIG. 3 is a front view of the lash adjuster of a second embodiment.
Figure 4:
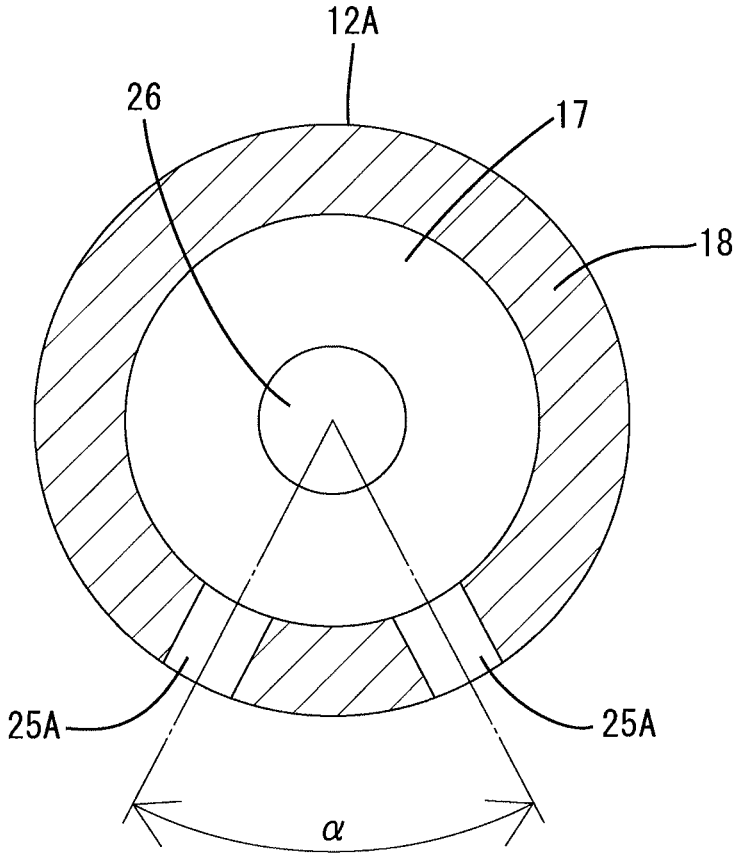
FIG. 4 is a sectional view taken along line A-A in FIG. 3.

FIGS. 3 and 4 illustrate a second embodiment. The second embodiment differs from the first embodiment in the locations of the plunger oil holes 25A formed through the peripheral wall 18 of the plunger 12A, and the like. The second embodiment is similar to the first embodiment in the other respects. Hence, identical or similar parts in the second embodiment are labeled by the same reference symbols as those in the first embodiment, and the duplicate description will be eliminated in the following.

Two plunger oil holes 25A are formed through the peripheral wall 18 so as to extend in the radial direction (in the thickness direction of the peripheral wall 18) as in the first embodiment. However, the second embodiment differs from the first embodiment in that, as shown in FIG. 4, a circumferential separation angle (an opening angle) $\alpha$of each plunger oil hole 25A about a radial center of the plunger 12 (the center of the valve hole 26) is set to be in a range that is not less than 50 degrees and not more than 180 degrees. More specifically, the plunger oil holes 25A are located away from the radially opposed positions (both end locations) of the peripheral wall 18 so that the plunger oil holes 25A are radially non-coaxial.

According to the second embodiment, since the directions in which the respective plunger oil holes 25A extend through the peripheral wall 18 are set to be non-coaxial, flows of oil flowing through the respective plunger oil holes 25A into the low-pressure chamber 22 are prevented from colliding directly against each other when the oil is supplied into the low-pressure chamber 22 and can prevent occurrence of bubbles resulting from oil interference in the low-temperature chamber 22. This can avoid the case where bubbles are suctioned into the high-pressure chamber 27. Furthermore, When the circumferential separation angle a made between the circumferentially adjacent plunger oil holes 25A is not less than at least 50 degrees, a necessary rigidity of the peripheral wall 18 of the plunger 12 can be ensured, and the process of forming the plunger oil holes 25A can easily be executed.

Third Embodiment

Figure 5:
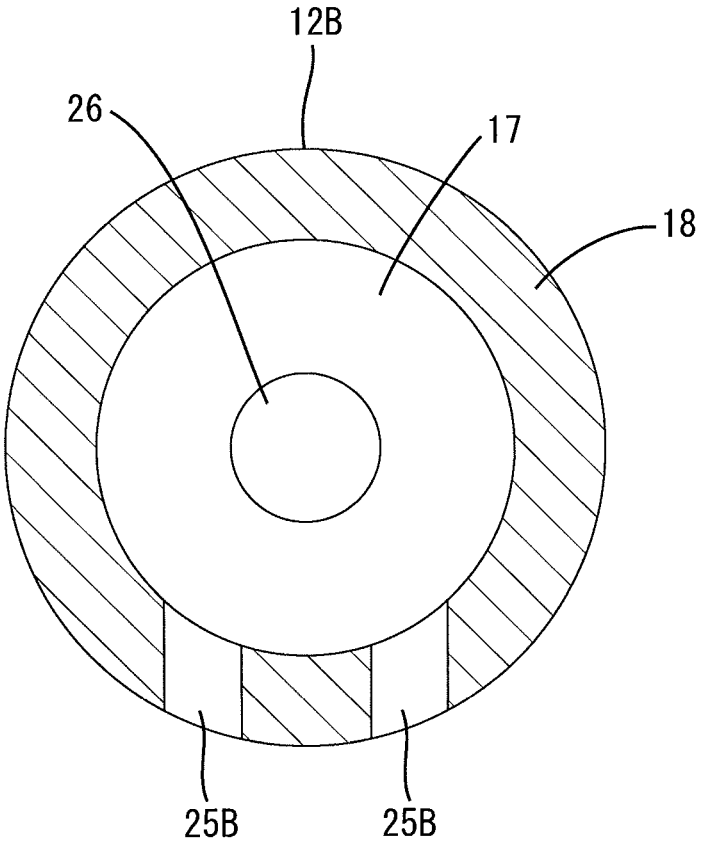
FIG. 5 is a view similar to FIG. 4, showing the lash adjuster of a third embodiment.

FIG. 5 illustrates a third embodiment. The third embodiment differs from the first and second embodiments in that two plunger oil holes 25B are formed through the peripheral wall 18 of the plunger 12B so as to be substantially in parallel to each other and that the extending directions of the plunger oil holes 25B are not directed in the radial direction of the peripheral wall 18. The plunger oil holes 25B are located to be non-coaxial with each other in the peripheral wall 18, in the same manner as in the second embodiment. More specifically, the plunger oil holes 25B are juxtaposed in one of two semicircular portions of the peripheral wall 18 at both side symmetrical positions with respect to a radially middle portion of the peripheral wall 18.

According to the third embodiment 3, the oil flowing through one plunger oil hole 25B into the low-pressure chamber 22 and the oil flowing through the other oil hole 25B into the low-pressure chamber 22 flow in parallel to each other in the identical direction. Accordingly, occurrence of bubbles due to oil interference in the low-pressure chamber 22 can be prevented more reliably. Furthermore, since the directions in which the respective plunger oil holes 25B extend through the peripheral wall 18 need not be arranged in the radial direction of the peripheral wall 18, the process of forming the plunger oil holes 25B can be rendered easier.

The lash adjuster of the present invention should not be limited by the above-described embodiments. For example, three or more plunger oil holes may be formed through the peripheral wall of the plunger. Furthermore, the lash adjuster may be installed to be inclined relative to the cylinder head in the up-down direction. Still furthermore, each plunger oil hole may have a hole diameter varying within a range of the thickness of the peripheral wall in a manner such that the diameter of each plunger oil hole is increased from an inner peripheral surface of the plunger toward a outer peripheral surface of the plunger.

What is claimed is:

1. A lash adjuster comprising:

a bottomed cylindrical body having a peripheral wall; and a bottomed cylindrical plunger inserted into the body so as to be reciprocable in an up-down direction and having a bottom wall and a peripheral wall, the plunger having an interior in which a low-pressure chamber is defined, the bottom wall of the plunger defining a high-pressure chamber in conjunction with a lower inner part of the body therebetween, the bottom wall of the plunger having a valve hole which is formed therethrough and through which an operating oil stored in the low-pressure chamber is allowed to flow into the high-pressure chamber when the valve hole is opened, wherein the peripheral wall of the plunger is provided with an annular band portion abutting against an upper end of the peripheral wall of the body and has a plurality of plunger oil holes extending therethrough so as to be located below the band portion, the plurality of plunger oil holes including respective lower ends defining a level of the operating oil stored in the low-pressure chamber; and wherein the peripheral wall of the body has a body oil hole communicating with the plurality of plunger oil holes and forming, together with the plurality of plunger oil holes, a path through which the operating oil flows into the low-pressure chamber;

wherein the plurality of plunger oil holes are located at a common height position of the peripheral wall on the plunger in the up-down direction, each of the plurality of plunger oil holes having a smaller diameter than the body oil hole.

2. The lash adjuster according to claim 1, wherein the plurality of plunger oil holes have respective circular cross-sections.

3. The lash adjuster according to claim 1, wherein circumferentially adjacent plunger oil holes have a circumferential separation angle of at least 50 degrees.

4. The lash adjuster according to claim 1, wherein respective directions in which each of the plurality of plunger oil holes extend through the peripheral wall of the plunger are non-coaxial with each other.

5. The lash adjuster according to claim 4, wherein the respective directions in which each of the plurality of plunger oil holes extend through the peripheral wall of the plunger are not oriented in a radial direction of the peripheral wall of the plunger.

6. The lash adjuster according to claim 4, wherein circumferentially adjacent plunger oil holes have a circumferential separation angle of at least 50 degrees and less than 180 degrees.

7. The lash adjuster according to claim 1, wherein a total of two plunger oil holes are provided and the two plunger oil holes each have a circular cross-section.

8. The lash adjuster according to claim 1, wherein the plurality of plunger oil holes open into a circumferential groove provided in an outer periphery of the plunger.

9. The lash adjuster according to claim 8, wherein the common height position places the plurality of plunger oil holes closer to the band portion than a lower end of the circumferential groove.

* * * * *